US009368858B2

(12) United States Patent
Lin

(10) Patent No.: US 9,368,858 B2
(45) Date of Patent: Jun. 14, 2016

(54) INTERNAL LC ANTENNA FOR WIRELESS COMMUNICATION DEVICE

(71) Applicant: Ethertronics, Inc., San Diego, CA (US)

(72) Inventor: Weichun Lin, San Diego, CA (US)

(73) Assignee: ETHERTRONICS, INC., San Diego, CA (US)

( * ) Notice: Subject to any disclaimer, the term of this patent is extended or adjusted under 35 U.S.C. 154(b) by 0 days.

(21) Appl. No.: 14/595,155

(22) Filed: Jan. 12, 2015

(65) Prior Publication Data

US 2015/0194725 A1 Jul. 9, 2015

Related U.S. Application Data

(63) Continuation of application No. 12/883,610, filed on Sep. 16, 2010, now abandoned, which is a continuation of application No. 12/776,333, filed on May 7, 2010, now abandoned.

(60) Provisional application No. 61/176,438, filed on May 7, 2009.

(51) Int. Cl.

| | |
|---|---|
| ***H01Q 5/00*** | (2015.01) |
| ***H01Q 1/24*** | (2006.01) |
| ***H01Q 9/04*** | (2006.01) |
| ***H01Q 5/357*** | (2015.01) |
| ***H01Q 1/48*** | (2006.01) |

(52) U.S. Cl.

CPC ..... *H01Q 1/243* (2013.01); *H01Q 1/48* (2013.01); *H01Q 5/357* (2015.01); *H01Q 9/0407* (2013.01); *H01Q 9/0421* (2013.01)

(58) Field of Classification Search

CPC ..... H01Q 1/2258; H01Q 1/2266; H01Q 1/24; H01Q 1/241; H01Q 1/242; H01Q 1/243; H01Q 1/38; H01Q 5/00; H01Q 5/0003; H01Q 5/02; H01Q 5/001; H01Q 5/0024; H01Q 5/0027; H01Q 9/065; H01Q 9/16; H01Q 9/26; H01Q 9/285; H01Q 5/30; H01Q 5/307; H01Q 5/342; H01Q 5/357; H01Q 5/364; H01Q 5/371

USPC ..... 343/702, 700 MS, 729, 730, 795, 810, 343/893

See application file for complete search history.

(56) References Cited

U.S. PATENT DOCUMENTS

| | | | | |
|---|---|---|---|---|
| 5,019,832 | A * | 5/1991 | Ekdahl | 343/774 |
| 6,239,765 | B1 * | 5/2001 | Johnson et al. | 343/795 |
| 6,882,317 | B2 * | 4/2005 | Koskiniemi et al. | 343/700 MS |
| 7,068,230 | B2 * | 6/2006 | Qi et al. | 343/702 |
| 7,113,135 | B2 * | 9/2006 | Jo et al. | 343/702 |
| 8,188,926 | B2 * | 5/2012 | Ganwani et al. | 343/700 MS |

* cited by examiner

*Primary Examiner* — Sue A Purvis
*Assistant Examiner* — Patrick Holecek
(74) *Attorney, Agent, or Firm* — Coastal Patent Law Group, P.C.

(57) ABSTRACT

An L-shape Corner (LC) Antenna uses an L shaped antenna on the corner of a circuit board of a wireless device. A low band element is positioned and designed to resonate along the long dimension of the adjacent ground plane while a high band element is positioned and designed to resonate along the short dimension of the adjacent ground plane. The single antenna element provides two separate radiating sections that allow for optimization of low and high band resonances that are often required to service the cellular and other wireless frequency bands. The two radiating sections of the antenna provide different polarizations for the two resonances that assist in de-coupling the two resonances from each other.

9 Claims, 5 Drawing Sheets

INTERNAL LC ANTENNA FOR WIRELESS COMMUNICATION DEVICE

CROSS-REFERENCE TO RELATED APPLICATIONS

This application is a continuation of U.S. Ser. No. 12/883,610, filed Sep. 16, 2010, titled "INTERNAL LC ANTENNA FOR WIRELESS COMMUNICATION DEVICE";

which is a continuation of U.S. application Ser. No. 12/776,333, filed May 7, 2010, titled "INTERNAL LC ANTENNA FOR WIRELESS COMMUNICATION DEVICE";

which claims priority to U.S. Provisional Application Ser. No. 61/176,438, filed May 7, 2009;

the entire contents of each of which is hereby incorporated by reference.

FIELD OF THE INVENTION

This invention relates to antennas for wireless communications; and more particularly, to an internal multi-band antenna for wireless applications and methods for forming said antennas.

BACKGROUND OF THE INVENTION

As handsets and other wireless communication devices become smaller and embedded with more applications, new antenna designs are required to address inherent limitations of these devices. Many such devices require coverage in low-frequency ranges, sometimes in addition to higher frequency communication ranges.

Wireless devices are also experiencing a convergence with other mobile electronic devices. Due to increases in data transfer rates and processor and memory resources, it has become possible to offer a myriad of products and services on wireless devices that have typically been reserved for more traditional electronic devices. Antennas in these devices will need to operate over multiple frequencies, including traditional cellular communication frequencies of, for example, 800/900 Mhz and 1800/1900 Mhz.

Because of consumer demands and other trends in the wireless device industry, product requirements are becoming increasingly smaller, thus components for these devices will need to be smaller and novel solutions for fitting antennas and other components within the device will be needed to be provide competitive low profile devices.

As antennas are made smaller, problems such as coupling of antenna elements and other interferences are increasingly observed. To provide modern practical antennas and wireless devices, a need for novel solutions for antenna optimization is needed.

This invention includes improvements to known antenna elements such as Isolated Magnetic Dipole (IMD) antennas. Isolated Magnetic Dipole antennas are disclosed in commonly owned U.S. Pat. No. 6,456,243; U.S. Pat. No. 6,567,053; U.S. Pat. No. 6,677,915; and U.S. Pat. No. 6,717,551; the entire contents of which are hereby incorporated by reference.

This invention further includes improvements to antenna circuit designs, for example designs which incorporate an antenna into the PCB board of the antenna circuit. FR-4, an abbreviation for Flame Retardant 4, is a type of material used for making a printed circuit board (PCB). It describes the board substrate, with no copper layer. The FR-4 used in PCBs is typically UV stabilized with a tetra functional epoxy resin system. FR-4 is similar to an older material called G-10. G-10 lacked FR-4's self-extinguishing flammability-characteristics. FR-4 has widely replaced G-10 in most applications. Furthermore, this invention utilizes known methods for chemical etching or printing of conductors on a surface of a PCB board.

Those having skill in the art will recognize that antennas used within portable electronic devices have a variety of performance related problems. Particularly, when placed on a printed circuit board, these antennas tend to couple to the electrical components of the circuit. Additionally, the circuit board acts as a ground plane for which the antenna operates with. Therefore, performance of these antennas is largely affected by dimensional size and proximity of adjacent circuit boards.

Limitations with respect to the size of a printed circuit board are generally a product of the circuit components. In practice, printed circuit boards for portable electronic devices are generally not designed for antenna optimization, but rather they are designed to fit each of the required components within a minimal volume. For this reason, there is a need for an antenna capable of operating over multiple bands while preserving a minimal volume requirement and having an optimized performance in light of minimal circuit board dimensions.

SUMMARY OF THE INVENTION

These and other problems are addressed in various embodiment of the invention, wherein an L-shaped antenna is etched or otherwise embedded into a corner section of a printed circuit board (PCB). The L-shaped Corner (LC) antenna comprises a first resonant section, and a second resonant section disposed perpendicular with the first resonant section. Each of the first and second resonant sections are adapted to operate with a respective length of the PCB, wherein the length of PCB functions as a ground plane. The LC antenna is a single-feed driven antenna capable of operating over multiple bands.

By fabricating an LC antenna on a corner of a PCB board, the antenna is capable of utilizing the circuit board as the ground plane, thereby reducing space of the associated device. Furthermore, by providing an L-shaped antenna having perpendicular resonant sections, a multi-band antenna is provided while minimizing space associated with the portable electronic device.

The first resonant section of the antenna may be configured as a low band resonator; wherein the first resonant section is disposed above and perpendicular with the larger of the length and width of the PCB ground plane. Similarly, the second resonant section may be configured as a high band resonator; wherein the second resonant section is disposed above and perpendicular with the lesser of the length and width of the PCB ground plane. In this regard, the longer section of the ground plane is about ¼ wavelength of the low-band frequency, while the shorter section of the ground plane is about ¼ wavelength of the high band frequency.

The PCB may be optimized for providing optimal dimensions of the associated ground plane(s). For example, the length and width of the ground plane can be increased or decreased as desired to obtain proper dimensions for performing over a desired high band and low band frequency.

Other embodiments and methods for forming LC antennas will be described in detail herein with particular reference to the appended figures.

BRIEF DESCRIPTION OF THE DRAWINGS

These and other attributes of the invention are further described in the following detailed description, particularly when reviewed in conjunction with the drawings, wherein.

DETAILED DESCRIPTION OF THE PREFERRED EMBODIMENTS

Figure 1:
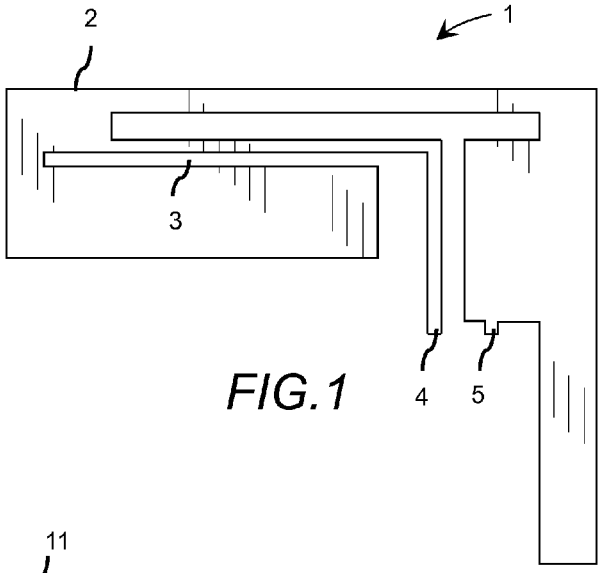
FIG. 1 illustrates a top view of an L-shaped Corner (LC) antenna according to various embodiments of the invention.

An internal multi-band antenna for wireless applications has been developed, the antenna provides a highly optimized antenna solution. The bandwidth and band separation challenges that are typically present in wireless antenna design applications are addressed with this new type antenna.

Internal antennas used for wireless applications are affected by the dimensions of the ground plane that the antenna operates with. The circuit board of the wireless device is typically used as the ground plane for the antenna. The circuit board dimensions are chosen to accommodate the wireless circuit, and are generally not optimized for antenna performance. A ground plane that is one quarter wave length in extent is optimal for antenna performance.

The invention provides a single feed antenna that is comprised of two resonant sections positioned at the corner of a circuit board. The antenna can provide improved performance over antennas of the prior art if the antenna is shaped with the two sections perpendicular to each other and with the low band resonant section positioned in such a manner that the optimal circuit board dimension is aligned with the low band resonant section. If the high band resonant section is positioned to operate when aligned with the shorter ground plane dimension, the overall antenna performance will be optimized.

The L-shape Corner (LC) Antenna uses an L shaped antenna positioned on a corner of a circuit board of a wireless device. The low band element is positioned and designed to be resonate along the long edge of the adjacent ground plane while the high band element is positioned and designed to be resonate along the short edge of the adjacent ground plane. The printed circuit board (PCB) of the wireless device that the antenna is integrated into can provide the ground plane function. The single antenna element provides two separate radiating sections that allow for optimization of low and high band resonances that are often required to service the cellular and other wireless frequency bands. The two radiating sections of the antenna provide different polarizations for the two resonances that assist in de-coupling the two resonances from each other. Both antenna elements can be an Isolated Magnetic Dipole (IMD) antenna; conversely, one or neither of the antenna elements can be an IMD element.

This antenna design can be configured in a two dimensional form factor, allowing for etching the antenna element directly into the PCB of the wireless device. In this embodiment, the antenna and wireless circuit board are formed form a single monolithic piece.

Alternately, the antenna element can be fabricated on a separate substrate, with this substrate attached to the PCB. This technique can be used when additional efficiency is required and the losses associated with FR-4 or other high-loss substrates commonly used in the circuit board industry cannot be tolerated.

In one embodiment of the invention, an antenna is manufactured by providing a substrate, etching an antenna element into the substrate, wherein the substrate is used to manufacture the wireless circuit board. The etched antenna can be an IMD or other antenna element. The etched antenna can be an LC antenna element having two resonant sections disposed perpendicular with one another.

In another embodiment of the invention, an antenna for use in a wireless device is provided. The antenna comprising; a first resonant section, a second resonant section, and a common ground plane; said first resonant section oriented substantially perpendicular to said second resonant section, wherein said first resonant section, said second resonant section, and said ground plane are oriented in a common plane. The first resonant section can be a Low band resonant section and the second resonant section can be a high band resonant section. The Low band resonant section is positioned with the longer side of a ground plane, and the High band resonant section is positioned with the shorter side of the ground plane, such that the antenna performance is optimized.

In yet another embodiment of this invention, an article of manufacture for inclusion in a wireless device is provided. The article of manufacture comprising; a single piece substrate having a first portion and a second portion; said first portion comprising an etched antenna element, said second portion comprising a ground plane, wherein said ground plane is adapted for integration with a wireless circuit. The article of manufacture can comprise an antenna element such as an Isolated Magnetic Dipole Antenna. Other antenna elements can be incorporated into this embodiment.

In another embodiment of the invention, a method is provided for manufacturing a circuit board having an internal LC antenna. The method comprising the steps of; providing a substrate, etching an L-shaped antenna element into said substrate at a corner of the substrate, wherein the antenna includes a first resonant section disposed perpendicular with a second resonant section.

In another embodiment of the invention, a method is provided for manufacturing a circuit board having an internal LC antenna. The method comprising the steps of; providing a substrate having an LC antenna etched at a corner of said substrate; and attaching said substrate to a printed circuit board of an electronic device.

Now turning to the drawings, certain embodiments of the invention are further described by way of example. FIG. 1 illustrates an L-shaped corner (LC) antenna 1. The LC antenna 1 includes a two dimensional design comprising a monolithic conductor 2 having two resonant sections disposed perpendicular with respect to one another. The antenna element includes a single feed 5 for driving the multiple resonant sections, and a ground pin 4 for connecting the antenna to a ground plane. The LC antenna 1 includes one or more slots 3 creating one or more capacitive gaps about the antenna. The antenna impedance can be optimized by increasing length and or width of the one or more capacitive gap portions.

Figure 2A:
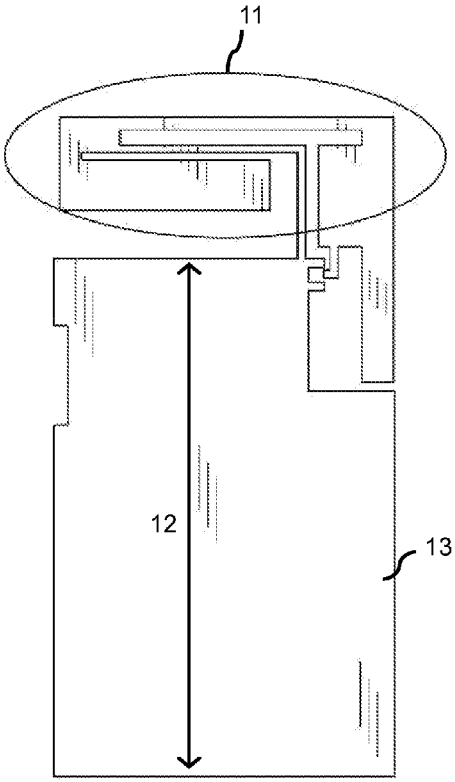
FIGS. 2(*a-b*) illustrate the LC antenna positioned on a ground plane for optimal performance. The low band and high band resonances are positioned to orient the ground plane dimensions to optimize antenna performance.
Figure 2B:
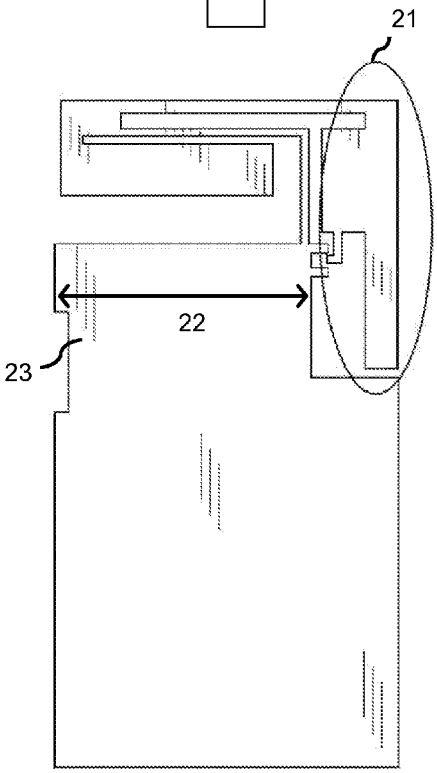

FIGS. 2(*a-b*) further illustrate the LC antenna attached to a ground plane conductor 13. The LC antenna includes a low band resonant section 11 positioned adjacent to a ground plane; the low band resonant section and ground plane are disposed in a common plane, and may therefore be etched from a monolithic piece. The low band resonant section 11 is further oriented about a longer dimension 12 of the ground plane 13. The LC antenna further includes a high band resonant section 21 disposed adjacent to a shorter dimension 22 of the ground plane 23. In this embodiment, the LC antenna includes a first low band resonant section, and a second high band resonant section disposed perpendicular to the first low band resonant section; wherein each of the resonant sections is oriented with a respective length of the ground plane conductor.

Figure 3:
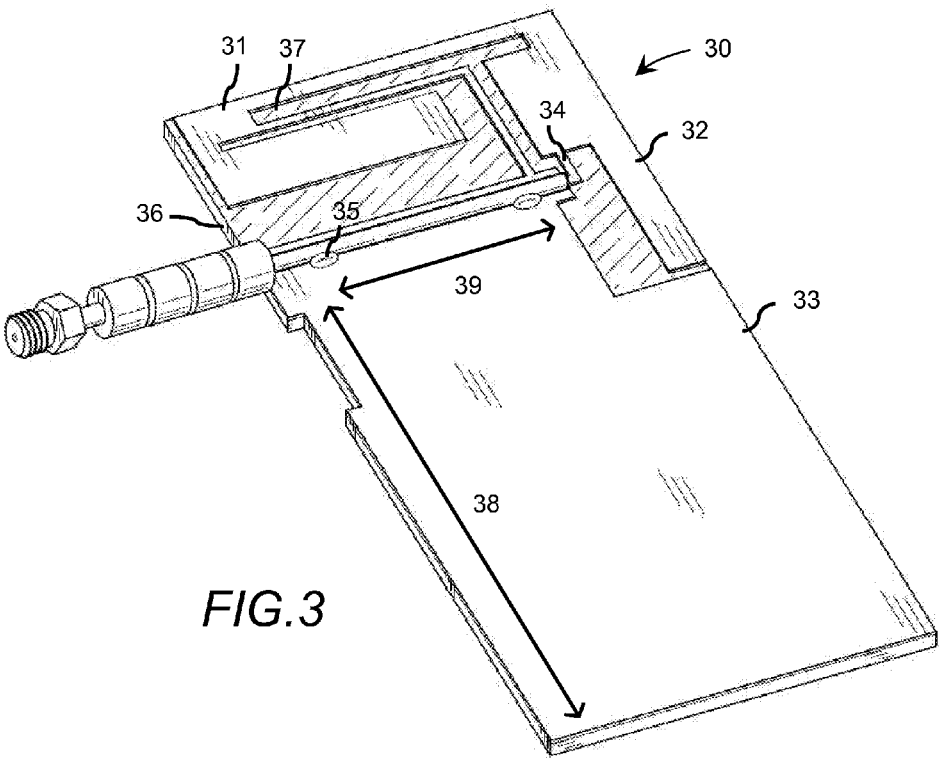
FIG. 3 illustrates a prototype of the LC antenna that was fabricated and tested by the inventors of this application; a coaxial cable is ferrite loaded and soldered to the ground plane at one end, and connected to the single antenna feed at another end.

The inventors of the LC antenna built and tested a prototype to ascertain performance characteristics of the inventive antenna. FIG. 3 illustrates a prototype of an LC antenna, the LC antenna 30 comprising a single antenna element having a first resonant section 31, and a second resonant section 32 being disposed perpendicular to the first resonant section. The LC antenna further comprises one or more slots 37 for generating a capacitive reactance with the antenna useful for impedance matching the antenna with the attached circuit. A single feed 34 drives both the first and second resonant sections of the antenna. In this particular embodiment, the antenna portion and ground plane are etched from a copper printed circuit board 36, although the antenna and ground can be etched, printed, or separately fabricated and attached to a printed circuit board. The ground plane conductor 33 has a long portion 38 oriented perpendicular and adjacent to the first resonant section 31; and a short portion 39 oriented perpendicular and adjacent to the second resonant section 32 of the LC antenna. A coaxial cable is optionally ferrite loaded and attached to the ground plane at a solder connection 35, and further attached to the single antenna feed 34. Although not illustrated, the ground plane may include a plurality of electronic circuit components.

Figure 4:
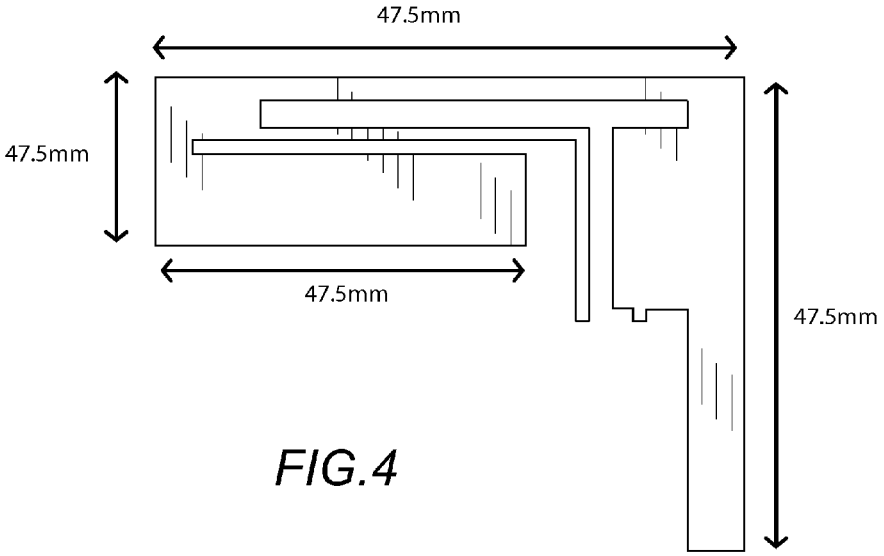
FIG. 4 illustrates the dimensions of the prototype antenna illustrated in FIG. 3; the antenna is designed to operate over the 800/900/1800/1900 frequency bands.
Figure 5:
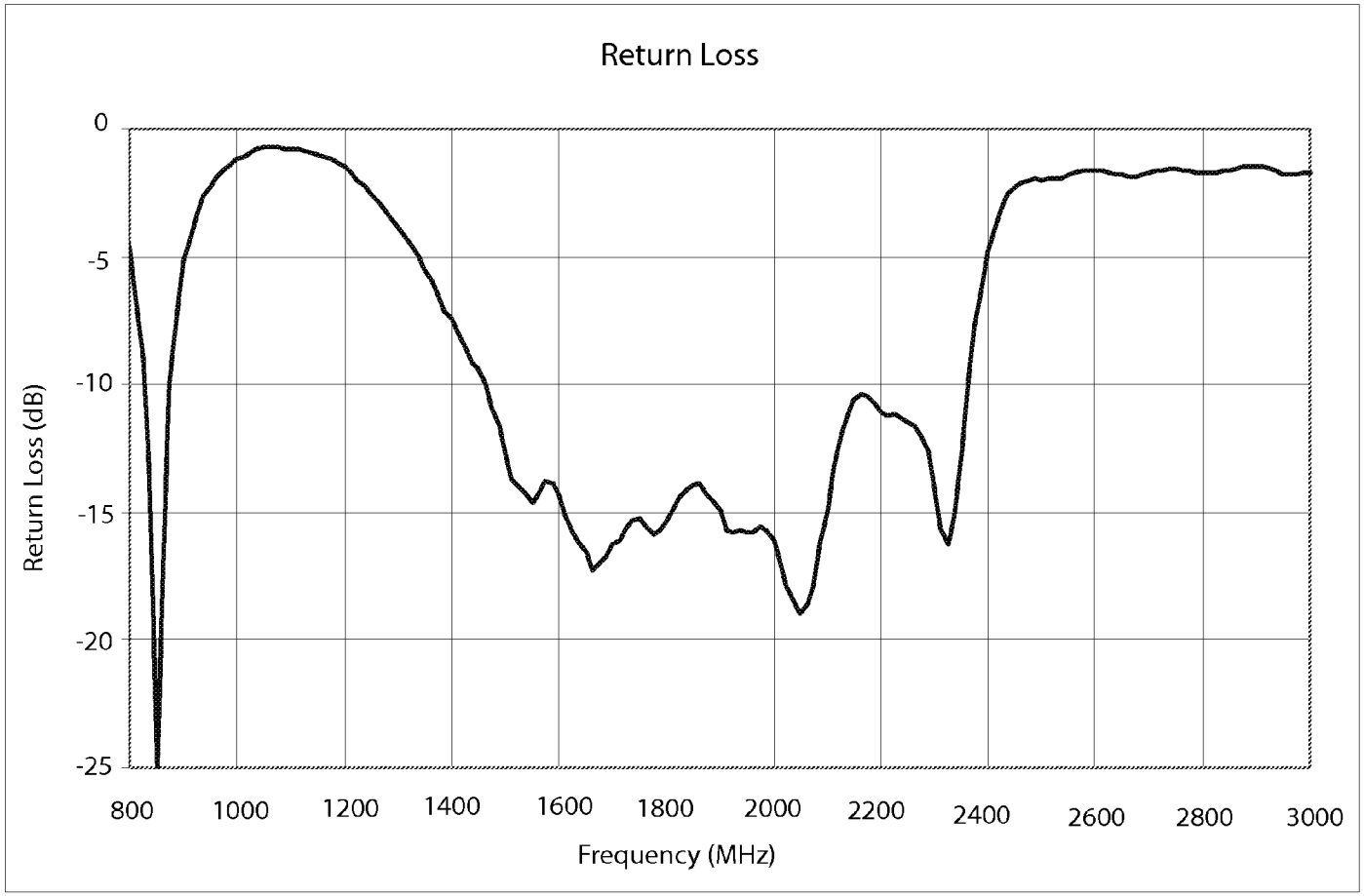
FIG. 5 is a plot of the measured return loss for the LC antenna shown in FIGS. 3-4.

The prototype antenna of FIG. 3 was optimized to operate over the 800/900 and 1800/1900 frequency bands; these bands are commonly used by telecommunications devices such as cellular phones. To optimize the antenna radiating sections, the illustrated dimensions of FIG. 4 were provided in the LC antenna of the FIG. 3 prototype. When tested, the antenna performance was measured in the form of return loss, and a plot is provided in FIG. 5. As can be ascertained by the plot of FIG. 5, the LC antenna provided optimized radiation characteristics (low loss) over the desired bandwidths.

Figure 6:
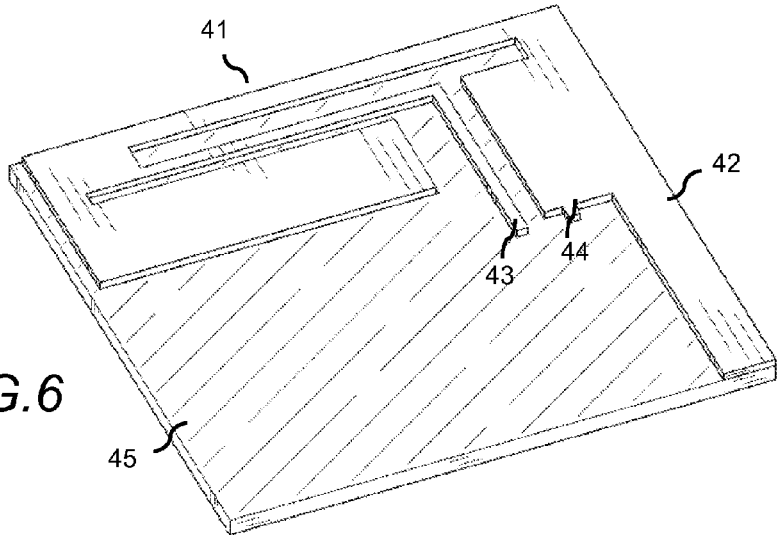
FIG. 6 illustrates an LC antenna attached to a corner surface of a circuit board.

FIG. 6 illustrates one method for fabricating an LC antenna, wherein the LC antenna is first configured on an independent substrate, the substrate and attached LC antenna can be attached to a circuit board. The LC antenna includes a first resonant section 41, and a second resonant section 42 being disposed perpendicular to the first resonant section. The LC antenna further includes a single antenna feed 44, and a ground pin 43.

Figure 7:
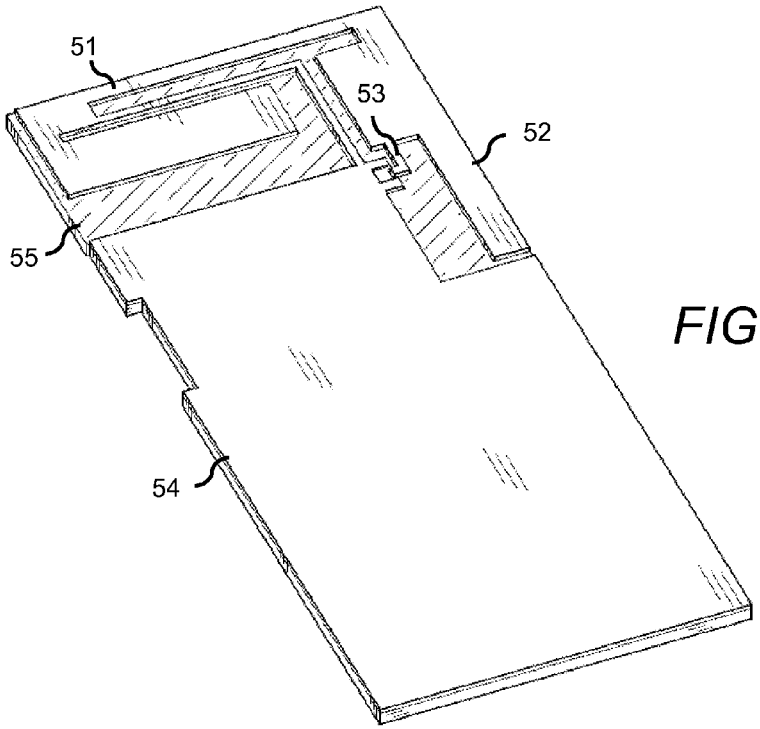
FIG. 7 illustrates an LC antenna etched into a printed circuit board along with an associated ground plane.

In an alternative embodiment, as illustrated in FIG. 7, the LC antenna and associated ground plane may be etched onto a circuit board using a chemical or other etching technique known in the art. The LC antenna including a first resonant section 51, and a second resonant section 52 being disposed perpendicular to said first resonant section. The LC antenna is connected to a ground plane 54. The antenna further comprises a single feed pin 53. Both the antenna and connected ground plane are etched on a circuit board substrate 55.

Figure 8:
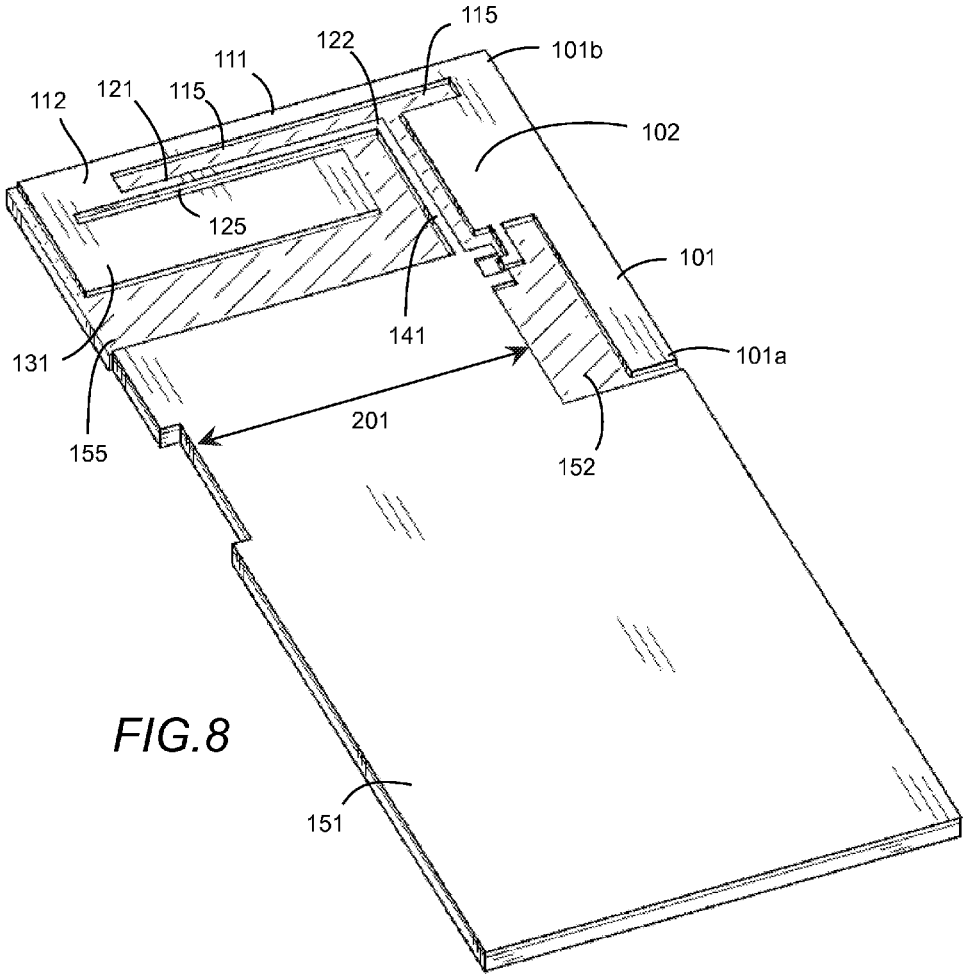
FIG. 8 illustrates an L-shaped corner (LC) antenna in accordance with one embodiment.

FIG. 8 further illustrates the L-shaped corner antenna of FIG. 7, the antenna including: a first vertical conductor 101 extending from a bottom end 101*a* to a top end 101*b*, the first vertical conductor further comprising a feed tab 102 extending outwardly from a side thereof; a first horizontal conductor 111 coupled to the top end 101*b* of the first vertical conductor 101 forming a first corner, the first horizontal conductor 111 extending perpendicularly from the top end 101*b* of the first vertical conductor 101 toward a distal end 112; a second horizontal conductor 121, the second horizontal conductor 121 being coupled to first horizontal conductor 101 at the distal end 112 and extending parallel therewith to a terminal end 122 of the second horizontal conductor, wherein a first gap 115 is formed in a region disposed between the first horizontal conductor 111 and the second horizontal conductor 121, said first gap 115 further extending into a region between the first horizontal conductor 111 and said feed tab 102; a third horizontal conductor 131, the third horizontal conductor 131 coupled to the first and second horizontal conductors 111; 121 at the distal end 112 thereof, the third horizontal conductor 131 extending parallel with the second horizontal conductor 121, wherein a second gap 125 is formed in a region disposed between the second horizontal conductor 121 and the third horizontal conductor 131; a vertical ground conductor 141 extending perpendicularly from the terminal end 122 of the second horizontal conductor 121, and a ground plane 151, the vertical ground conductor 141 being coupled to the ground plane 151; the ground plane further comprising a notch 152, wherein a portion of the first vertical conductor 101 extends into an area of the notch 152 and is configured to overlap with a short dimension 201 of the ground plane to form a high-band resonant section of the antenna, wherein said first vertical conductor 101, first through third horizontal conductors 111; 121; 131, and vertical ground conductor 141 collectively form an L-shaped antenna configured for positioning at a corner within a housing of a wireless communication device.

The embodiments disclosed herein are representative examples of the novel antenna solution. These embodiments are provided for illustrative purposes and are not intended as the only embodiments of the invention. Accordingly, the described embodiments are not intended to limit the spirit and scope of the invention.

What is claimed is:

1. An L-shaped corner antenna, the antenna comprising:

a first vertical conductor extending from a bottom end to a top end, the first vertical conductor further comprising a feed tab extending outwardly from a side thereof;

a first horizontal conductor coupled to the top end of the first vertical conductor forming a first corner, the first horizontal conductor extending perpendicularly from the top end of the first vertical conductor toward a distal end;

a second horizontal conductor, the second horizontal conductor being coupled to first horizontal conductor at the distal end and extending parallel therewith to a terminal end of the second horizontal conductor, wherein a first gap is formed in a region disposed between the first horizontal conductor and the second horizontal conductor, said first gap further extending into a region between the first horizontal conductor and said feed tab;

a third horizontal conductor, the third horizontal conductor coupled to the first and second horizontal conductors at the distal end thereof, the third horizontal conductor extending parallel with the second horizontal conductor, wherein a second gap is formed in a region disposed between the second horizontal conductor and the third horizontal conductor;

a vertical ground conductor extending perpendicularly from the terminal end of the second horizontal conductor, and a ground plane, the vertical ground conductor being coupled to the ground plane;

the ground plane further comprising a notch, wherein a portion of the first vertical conductor extends into an area of the notch and is configured to overlap with a short dimension of the ground plane to form a first resonant section of the antenna, wherein said first vertical conductor, first through third horizontal conductors, and vertical ground conductor collectively form an L-shaped antenna configured for positioning at a corner within a housing of a wireless communication device.

2. The antenna of claim 1, wherein said first vertical conductor, first through third horizontal conductors, and vertical ground conductor are each disposed within a common plane.

3. The antenna of claim 1, wherein said first resonant section is disposed adjacent to the short dimension of said ground plane.

4. The antenna of claim 1, wherein said first through third horizontal conductors are each oriented perpendicular to a long dimension of said ground plane forming a second resonant section of the antenna.

5. The antenna of claim 1, wherein each of said first vertical conductor, first through third horizontal conductors, vertical ground conductor, and ground plane are is etched on a printed circuit board.

6. The antenna of claim 1, wherein said ground plane further includes a plurality of electronic circuit components.

7. The antenna of claim 1, wherein said antenna is adapted to operate over the 800/900 MHz and 1800/1900 MHz frequency bands.

8. An L-shaped corner antenna, the antenna comprising:

a first vertical conductor extending from a bottom end to a top end, the first vertical conductor further comprising a feed tab extending outwardly from a side thereof;

a first horizontal conductor coupled to the top end of the first vertical conductor forming a first corner, the first horizontal conductor extending perpendicularly from the top end of the first vertical conductor toward a distal end;

a second horizontal conductor, the second horizontal conductor being coupled to first horizontal conductor at the distal end and extending parallel therewith to terminal end, wherein a first gap is formed in a region disposed between the first horizontal conductor and the second horizontal conductor, said first gap extending into a region between the first horizontal conductor and said feed tab;

a third horizontal conductor, the third horizontal conductor coupled to the first and second horizontal conductors at the distal end, the third horizontal conductor extending parallel with the second horizontal conductor, wherein a second gap is formed in a region disposed between the second horizontal conductor and the third horizontal conductor;

a vertical ground conductor extending perpendicularly from the terminal end of the second horizontal conductor; and a ground plane, the vertical ground conductor being coupled to the ground plane;

the ground plane further comprising a notch, wherein a portion of the first vertical conductor extends into an area of the notch and is configured to overlap with a short dimension of the ground plane to form a first resonant section of the antenna;

wherein said first through third horizontal conductors are each oriented perpendicular to a long dimension of said ground plane forming a second resonant section of the antenna; and wherein said first vertical conductor, first through third horizontal conductors, and vertical ground conductor collectively form an L-shaped antenna configured for positioning at a corner within a housing of a wireless communication device.

9. An L-shaped corner antenna, the antenna comprising:

a first vertical conductor extending from a bottom end to a top end, the first vertical conductor further comprising a feed tab extending outwardly from a side thereof;

a first horizontal conductor coupled to the top end of the first vertical conductor forming a first corner, the first horizontal conductor extending perpendicularly from the top end of the first vertical conductor toward a distal end;

a second horizontal conductor, the second horizontal conductor being coupled to first horizontal conductor at the distal end and extending parallel therewith to terminal end, wherein a first gap is formed in a region disposed between the first horizontal conductor and the second horizontal conductor, said first gap extending into a region between the first horizontal conductor and said feed tab;

a third horizontal conductor, the third horizontal conductor coupled to the first and second horizontal conductors at the distal end, the third horizontal conductor extending parallel with the second horizontal conductor, wherein a second gap is formed in a region disposed between the second horizontal conductor and the third horizontal conductor;

a vertical ground conductor extending perpendicularly from the terminal end of the second horizontal conductor;

wherein said first vertical conductor, first through third horizontal conductors, and vertical ground conductor collectively form an L-shaped antenna configured for positioning at a corner within a housing of a wireless communication device.

* * * * *